US011723817B2

(12) United States Patent
Xu et al.

(10) Patent No.: US 11,723,817 B2
(45) Date of Patent: Aug. 15, 2023

(54) PATIENT SUPPORT APPARATUS WITH A CARE STATION

(71) Applicant: Stryker Corporation, Kalamazoo, MI (US)

(72) Inventors: Shaofei Wilson Xu, Kalamazoo, MI (US); Lance E. Larsen, Grand Rapids, MI (US)

(73) Assignee: Stryker Corporation, Kalamazoo, MI (US)

( * ) Notice: Subject to any disclaimer, the term of this patent is extended or adjusted under 35 U.S.C. 154(b) by 0 days.

(21) Appl. No.: 17/844,334

(22) Filed: Jun. 20, 2022

(65) Prior Publication Data

US 2022/0313507 A1 Oct. 6, 2022

Related U.S. Application Data

(63) Continuation of application No. 17/077,003, filed on Oct. 22, 2020, now Pat. No. 11,395,776.

(60) Provisional application No. 62/924,297, filed on Oct. 22, 2019.

(51) Int. Cl.

| | |
|---|---|
| ***A61G 1/04*** | (2006.01) |
| ***A61G 1/013*** | (2006.01) |
| ***A61G 7/05*** | (2006.01) |
| ***A61G 7/012*** | (2006.01) |
| ***A61G 1/048*** | (2006.01) |

(52) U.S. Cl.

CPC ..... *A61G 1/013* (2013.01); *A61G 1/04* (2013.01); *A61G 1/048* (2013.01); *A61G 7/012* (2013.01); *A61G 7/05* (2013.01)

(58) Field of Classification Search

CPC ..... A61G 1/013; A61G 1/04; A61G 1/048; A61G 7/012; A61G 7/05; A61G 1/0275

See application file for complete search history.

(56) References Cited

U.S. PATENT DOCUMENTS

| | | | | |
|---|---|---|---|---|
| 4,393,529 | A | 7/1983 | Britz | |
| 5,129,117 | A * | 7/1992 | Celestina | A61G 7/0514 5/430 |
| 7,398,571 | B2 | 7/2008 | Souke et al. | |
| 9,486,373 | B2 | 11/2016 | Lambarth et al. | |
| 9,510,981 | B2 | 12/2016 | Lambarth et al. | |

(Continued)

OTHER PUBLICATIONS

U.S. Appl. No. 17/077,027, filed Oct. 22, 2020.

*Primary Examiner* — Fredrick C Conley
(74) *Attorney, Agent, or Firm* — Howard & Howard Attorneys PLLC

(57) ABSTRACT

A patient support apparatus supports a patient and includes a litter. The litter includes a patient support deck and extends longitudinally between first and second ends. The apparatus includes a litter lift device coupled to the litter and configured to raise and lower the patient support deck. The apparatus includes a care station coupled to the litter adjacent one of the first and second ends. The care station includes a docking frame coupled to the litter and defining an angle between the docking frame and the axis. The docking frame is arranged to pivot relative to the litter between a folded position an upright position. The angle in the folded position less than the angle in the upright position. The care station includes a utility module configured for use by a caregiver and arranged to selectively mount to the docking frame.

18 Claims, 10 Drawing Sheets

(56) References Cited

U.S. PATENT DOCUMENTS

| | | | | |
|---|---|---|---|---|
| 2002/0152555 | A1 | 10/2002 | Gallant et al. | |
| 2003/0009825 | A1 | 1/2003 | Gallant et al. | |
| 2003/0019038 | A1* | 1/2003 | Welling | G10L 15/26 5/503.1 |
| 2006/0162083 | A1* | 7/2006 | Heimbrock | A61G 7/001 5/81.1 R |
| 2009/0039666 | A1* | 2/2009 | Lambarth | A61G 1/0212 296/20 |
| 2010/0257673 | A1 | 10/2010 | Linares | |
| 2011/0030142 | A1* | 2/2011 | Karwal | A61G 7/005 5/608 |
| 2018/0021191 | A1* | 1/2018 | Lambarth | A61G 5/047 296/20 |
| 2018/0028383 | A1 | 2/2018 | Stryker et al. | |
| 2018/0177652 | A1 | 6/2018 | Furman et al. | |
| 2018/0185212 | A1 | 7/2018 | Lucas et al. | |
| 2018/0185213 | A1 | 7/2018 | Naber et al. | |
| 2018/0369036 | A1 | 12/2018 | Furman et al. | |
| 2020/0155380 | A1 | 5/2020 | Xu et al. | |
| 2021/0113394 | A1 | 4/2021 | Xu et al. | |

* cited by examiner

PATIENT SUPPORT APPARATUS WITH A CARE STATION

RELATED APPLICATIONS

This application is a Continuation of U.S. patent application Ser. No. 17/077,003, filed on Oct. 22, 2020, which claims priority to and the benefit of U.S. Provisional Patent Application No. 62/924,297, filed on Oct. 22, 2019, the disclosures of each of which are hereby incorporated by reference in their entirety.

BACKGROUND

Patient support apparatuses facilitate care of patients in a health care setting and are typically, for example, hospital beds, stretchers, cots, tables, wheelchairs, and chairs. A conventional patient support apparatus comprises a base and a litter upon which the patient is supported.

In certain circumstances (such as first response scenarios) caregivers must travel to the patient and transport the patient back to an emergency medical facility. The caregivers must transport the patient support apparatus, as well as other medical equipment, to the patient to provide care. Often, the caregivers must carry multiple items to the patient or carry the items individually to the patient over multiple trips, which is strenuous and increases the potential for injuring the caregiver.

DETAILED DESCRIPTION

Referring to FIGS. 1-6, a patient support apparatus is shown at 20 for supporting a patient 22 in a health care setting. As will be appreciated from the subsequent description below, while the illustrated embodiments of the patient support apparatus 20 described herein are configured as cots for transporting patients 22, the patient support apparatus 20 may comprise a hospital bed, a stretcher, a table, a wheelchair, a chair, or a similar apparatus utilized in the care of the patient 22.

In some embodiments, the patient support apparatus 20 may comprise a Reconfigurable Transport Apparatus as described in U.S. Pat. No. 9,486,373, which is hereby incorporated by reference in its entirety. In some embodiments, the patient support apparatus 20 may comprise a Reconfigurable Transport Apparatus as described in U.S. Pat. No. 9,510,981, which is hereby incorporated by reference in its entirety. In some embodiments, the patient support apparatus 20 may comprise a Person Support Apparatus System as described in U.S. Patent Application Publication No. 2018/0028383, which is hereby incorporated by reference in its entirety. In some embodiments, the patient support apparatus 20 may comprise a Patient Transfer Apparatus with Integrated Tracks as described in U.S. Patent Application Publication No. 2018/0185212, which is hereby incorporated by reference in its entirety. In some embodiments, the patient support apparatus 20 may comprise a Variable Speed Patient Transfer Apparatus as described in U.S. Patent Application Publication No. 2018/0177652, which is hereby incorporated by reference in its entirety. In some embodiments, the patient support apparatus 20 may comprise a Patient Transfer Apparatus as described in U.S. Patent Application Publication No. 2018/0185213, which is hereby incorporated by reference in its entirety. In some embodiments, the patient support apparatus 20 may comprise an Ambulance Cot and Hydraulic Elevating Mechanism Therefor as described in U.S. Pat. No. 7,398,571, which is hereby incorporated by reference in its entirety.

Figure 1:
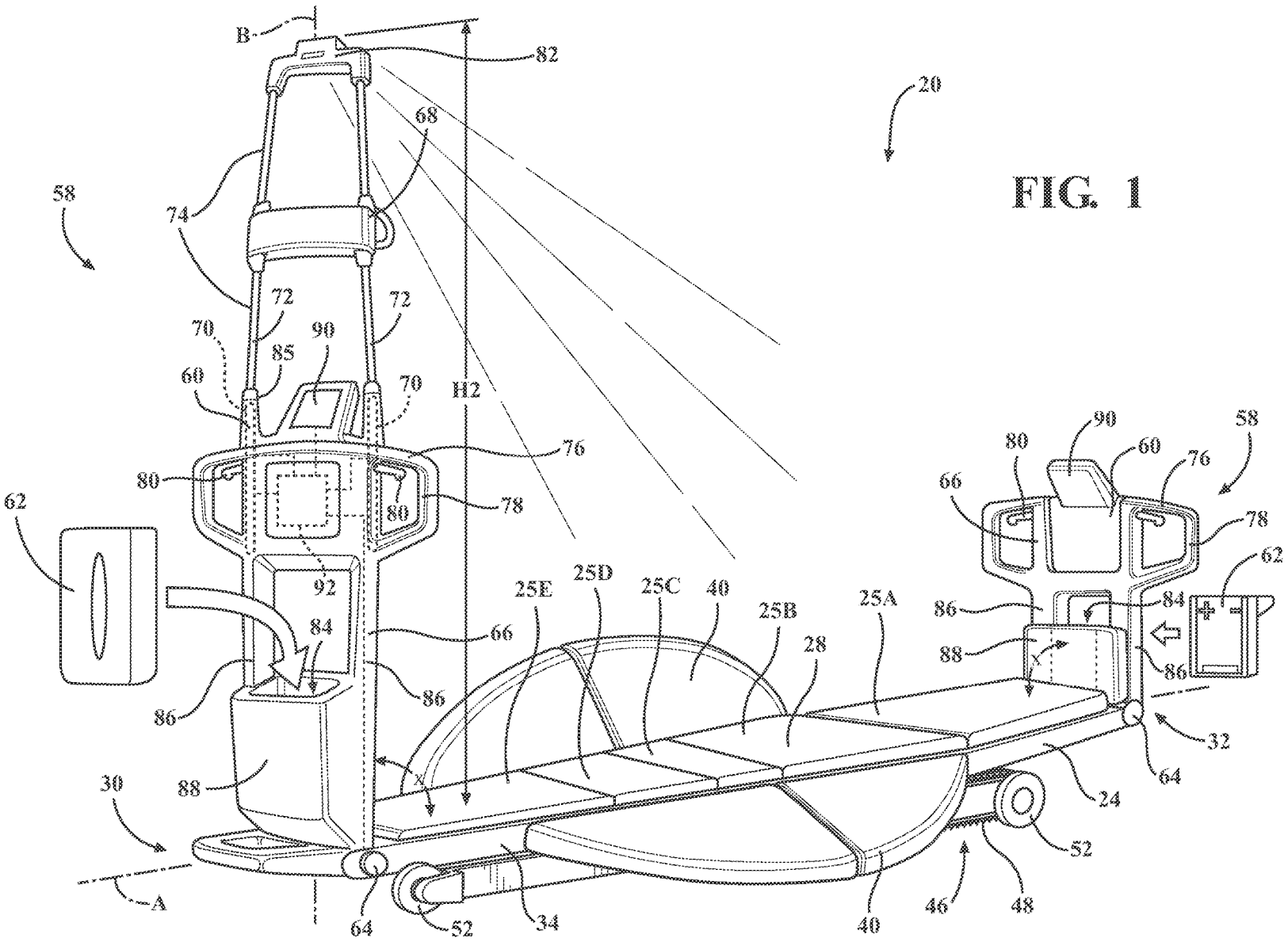
FIG. 1 is a perspective view of a patient support apparatus shown comprising a litter and a pair of care stations, with one of the pair of care stations comprising a portion in an extended position.
Figure 2:
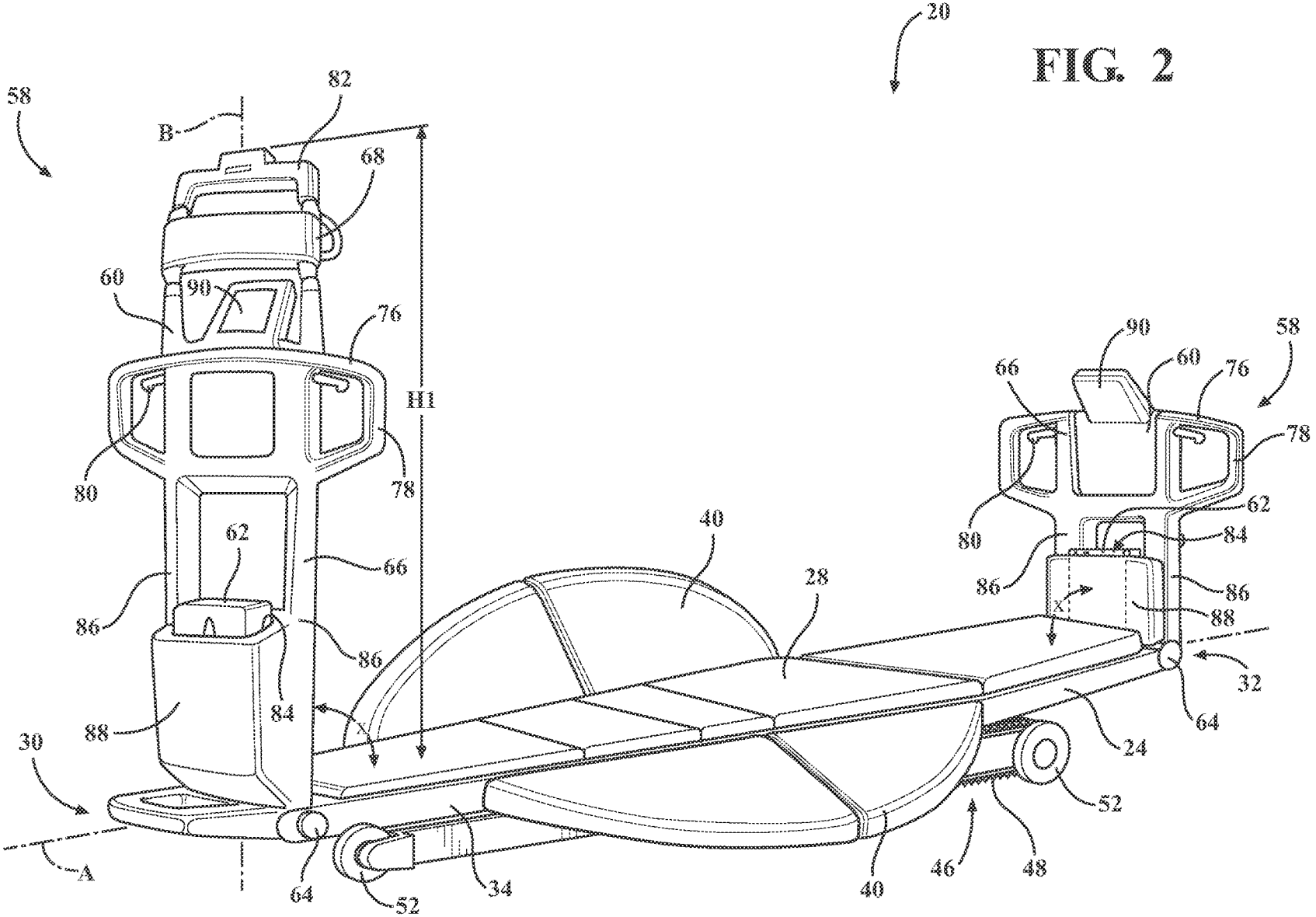
FIG. 2 is a perspective view of the patient support apparatus of FIG. 1, with the portion in a collapsed position.

In the illustrated embodiment, the patient support apparatus 20 comprises a litter 24 that extends longitudinally along an axis A between a first end 30 and a second end 32. The litter 24 comprises a patient support deck 28 configured to support the patient 22. The patient support deck 28 of the litter 24 may comprise a plurality of sections 25, as shown in FIGS. 1 and 2. In the embodiment shown in the Figures, the plurality of sections 25 are further defined as five sections 25A-E, positioned end-to-end in succession along the axis A between the first and second ends 30, 32 of the litter 24. Some or all of the sections 25A-E may be capable of being articulated relative to adjacent sections 25A-E. In one non-limiting example, section 25A may pivot relative to section 25B to configure the litter 24 to serve as a mobile chair to transport patients 22 up and down stairs. Mobile chairs (sometimes called "stair chairs") are used to evacuate patients 22 from buildings where patient accessibility is limited, such as buildings having more than one floor.

Figure 5:
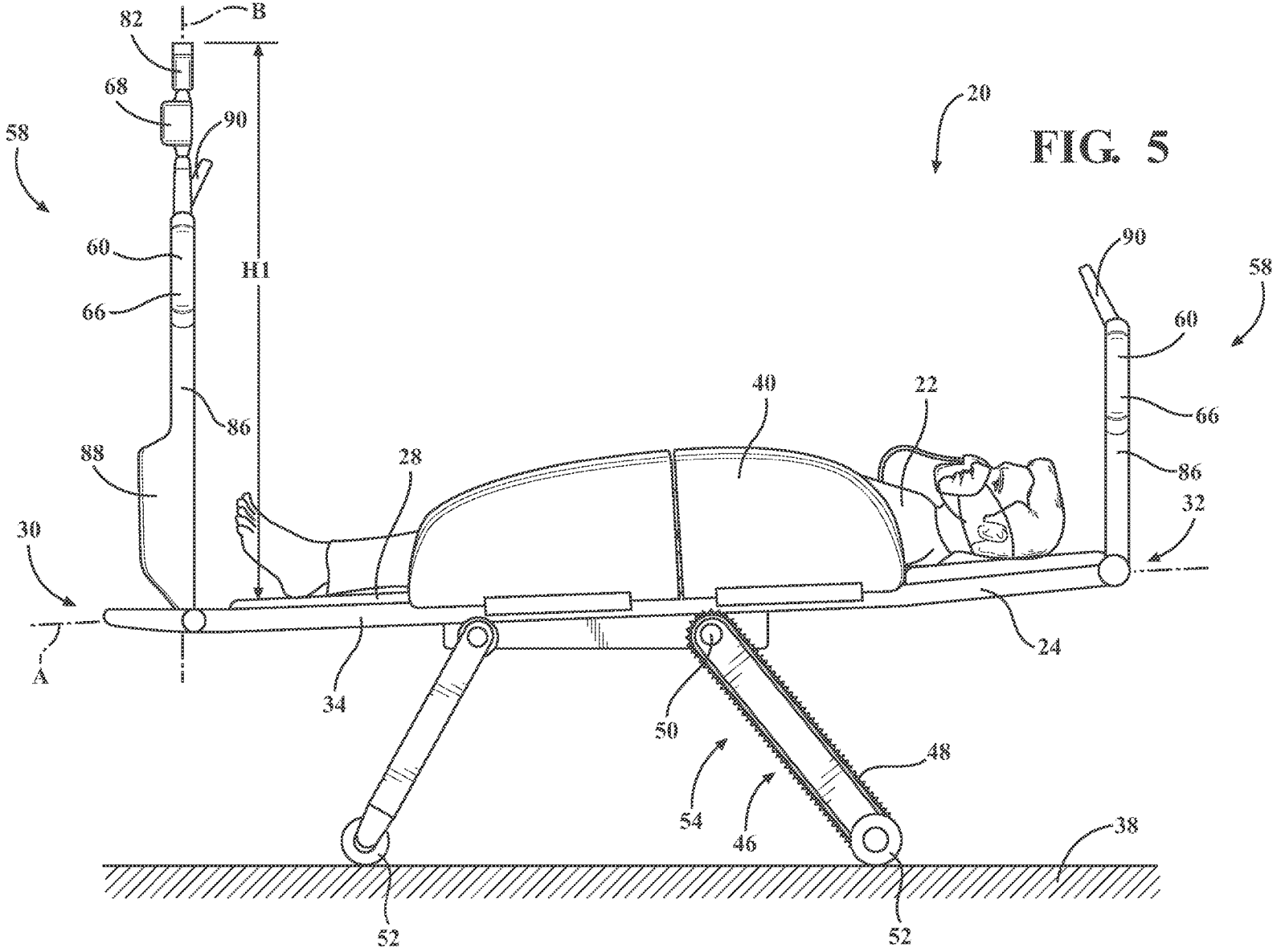
FIG. 5 is a side view of the patient support apparatus of FIG. 1, with the litter lift device supporting the litter in a lifted litter position.

As shown in FIG. 5, the patient support apparatus 20 further comprises a litter lift device 54 coupled to the litter 24 and configured to raise and lower the patient support deck 28 relative to the floor surface 38. More specifically, the litter lift device 54 may be configured to raise and lower the patient 22 between lifted (FIG. 5) and lowered (FIG. 4) litter positions of the litter 24, and intermediate positions therebetween. One non-limiting example of the operation of the litter lift device 54 may be found in U.S. Pat. No. 7,398,571 (incorporated by reference above). To this end, the illustrated litter lift device 54 may comprise one or more litter lift actuators coupled to a controller and the litter 24 to raise and lower the patient support deck 28 relative to the floor surface 38. The litter lift device 54 may be powered (hydraulic, electric, etc.) or may be manually operated.

The patient support apparatus 20 may further comprise a transportation mechanism 46 coupled to the litter 24 for facilitating movement of the litter 24 along the floor surface 38, as shown in FIGS. 1-6. The transportation mechanism 46 may further comprise a continuous track 48 and a track driving device 50 propelling the continuous track 48 to provide mobility to the litter 24 along the floor surface 38. The track driving device 50 may also be configured to assist users in traversing a flight of stairs or rough/uneven surfaces that may not be easily traversed by the base 26 by mitigating the load users (e.g., caregivers) would otherwise be required to lift. In some configurations, the track driving device 50 may be configured to move the litter 24 across the floor surface 38 while the patient 22 is supported in a seated and/or a supine position. The track driving device 50 may further comprise wheels 52 rotatably coupled to the patient support deck 28 and configured to be disposed in contact with the floor surface 38. In the illustrated embodiments, the wheels 52 are freely rotatable. In alternative embodiments, the wheels 52 may be powered drive wheels that may be driven. The track driving device 50 may be configured to operate in the same manner or a similar manner as those shown in U.S. Pat. Nos. 9,486,373, 9,510,981, U.S. Patent Application Publication No. 2018/0185212, and/or U.S. Patent Application No. 2018/0177652, previously referenced.

Figure 7:
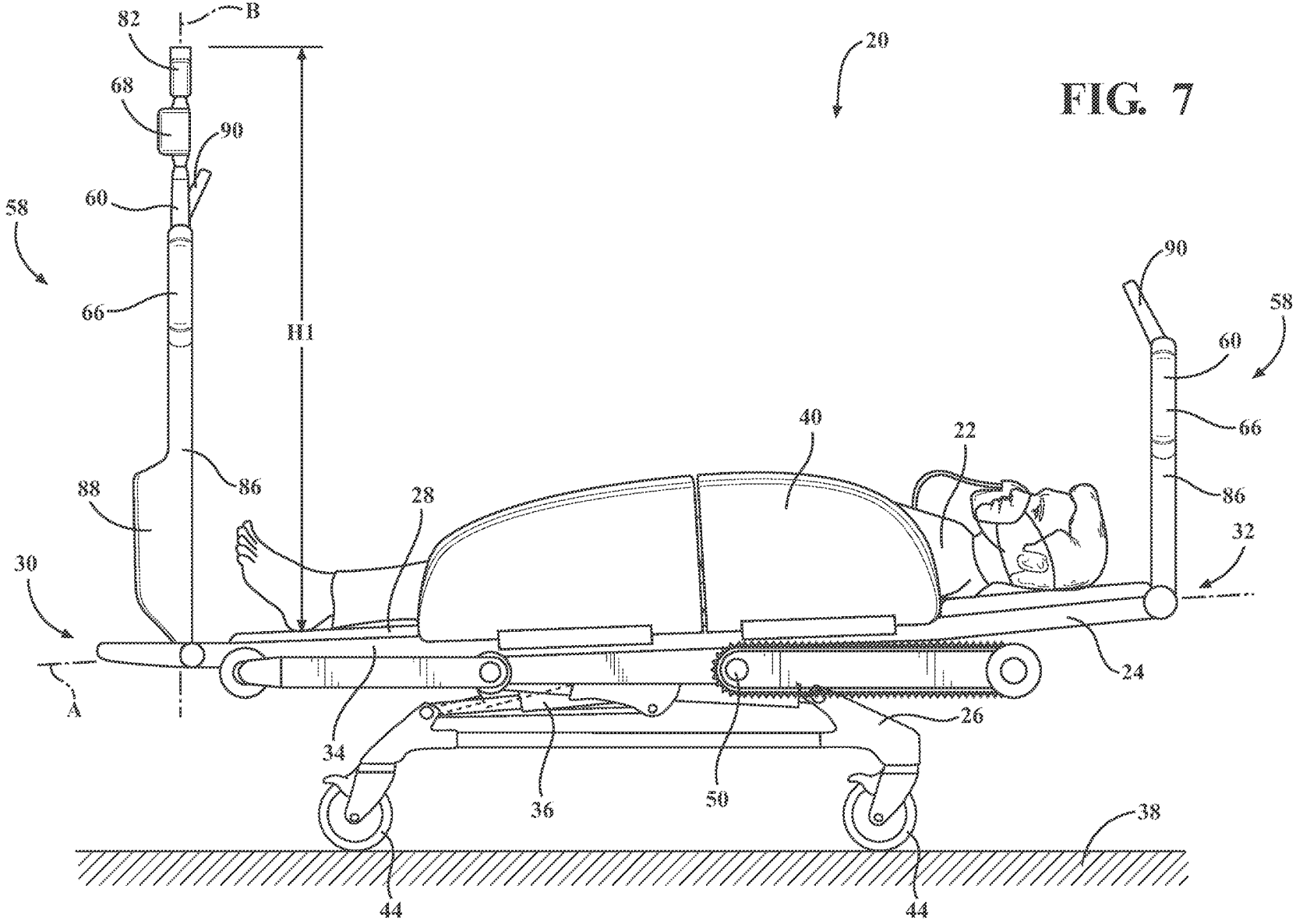
FIG. 7 is a side view of the patient support apparatus of FIG. 1, further comprising a base supporting the litter in a lowered base position.
Figure 8:
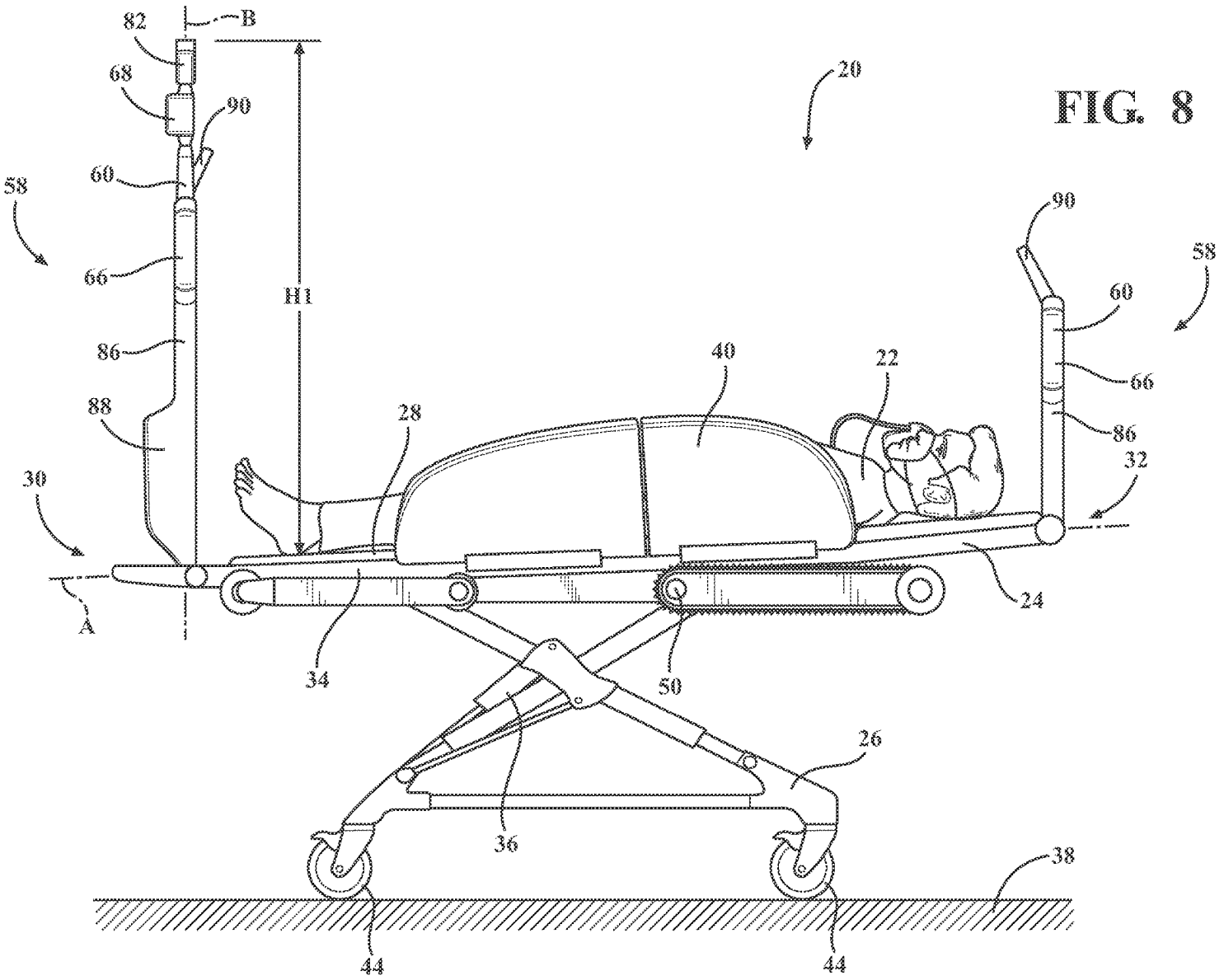
FIG. 8 is a side view of the patient support apparatus of FIG. 1, further comprising the base supporting the litter in a lifted base position.

As shown in FIGS. 7 and 8, the patient support apparatus 20 may comprise a base 26 to which the litter 24 may be selectively coupled for support. The base 26 may comprise a base lift device 36 configured to raise and lower the patient support deck 28 relative to the floor surface 38 when the litter 24 is coupled to the base 26. More specifically, the base lift device 36 may be coupled to the base 26 and may be configured to move the litter 24 relative to the floor surface 38 between lifted and lowered base positions of the litter 24, and intermediate positions therebetween when the litter 24 is supported by the base 26. The base lift device 36 may be configured to operate in the same manner or a similar manner as the base lift devices shown in U.S. Pat. Nos. 7,398,571, 9,486,373, 9,510,981, and/or U.S. Patent Application Publication No. 2018/0028383, previously referenced. The base lift device 36 may be powered (hydraulic, electric, etc.) or may be manually operated.

The base 26 may be configured for movement of the litter 24 along the floor surface 38 (e.g., the ground). More specifically, the base 26 may comprise wheels 44 to facilitate transport over the floor surface 38. The wheels 44 are arranged in each of four quadrants of the base 26. In the illustrated embodiments, the wheels 44 are caster wheels, which are able to rotate and swivel during transport. In addition, in some configurations, the wheels 44 are not caster wheels and may be non-steerable, steerable, non-powered, powered, or combinations thereof. Additional wheels are also contemplated. For example, the patient support apparatus 20 may comprise four non-powered, non-steerable wheels, along with one or more powered wheels. In some cases, the patient support apparatus 20 may not include any wheels. In other configurations, one or more auxiliary wheels (powered or non-powered), which are movable between stowed positions and deployed positions, may be coupled to the base 26. A fifth wheel may also be arranged substantially in a center of the base 26. Other configurations are contemplated.

The litter 24 may be selectively separable from the base 26. Said differently, the base 26 may be configured to removably receive and support the litter 24 in certain situations. In the illustrated embodiment, the litter 24 is configured for releasable attachment to the base 26. As will be appreciated from the subsequent description below, the litter 24 may be considered to be the patient support apparatus 20 both when it is attached to the base 26 (see FIGS. 7 and 8) and when it has been removed from the base 26 (see FIGS. 1-6).

Figure 3:
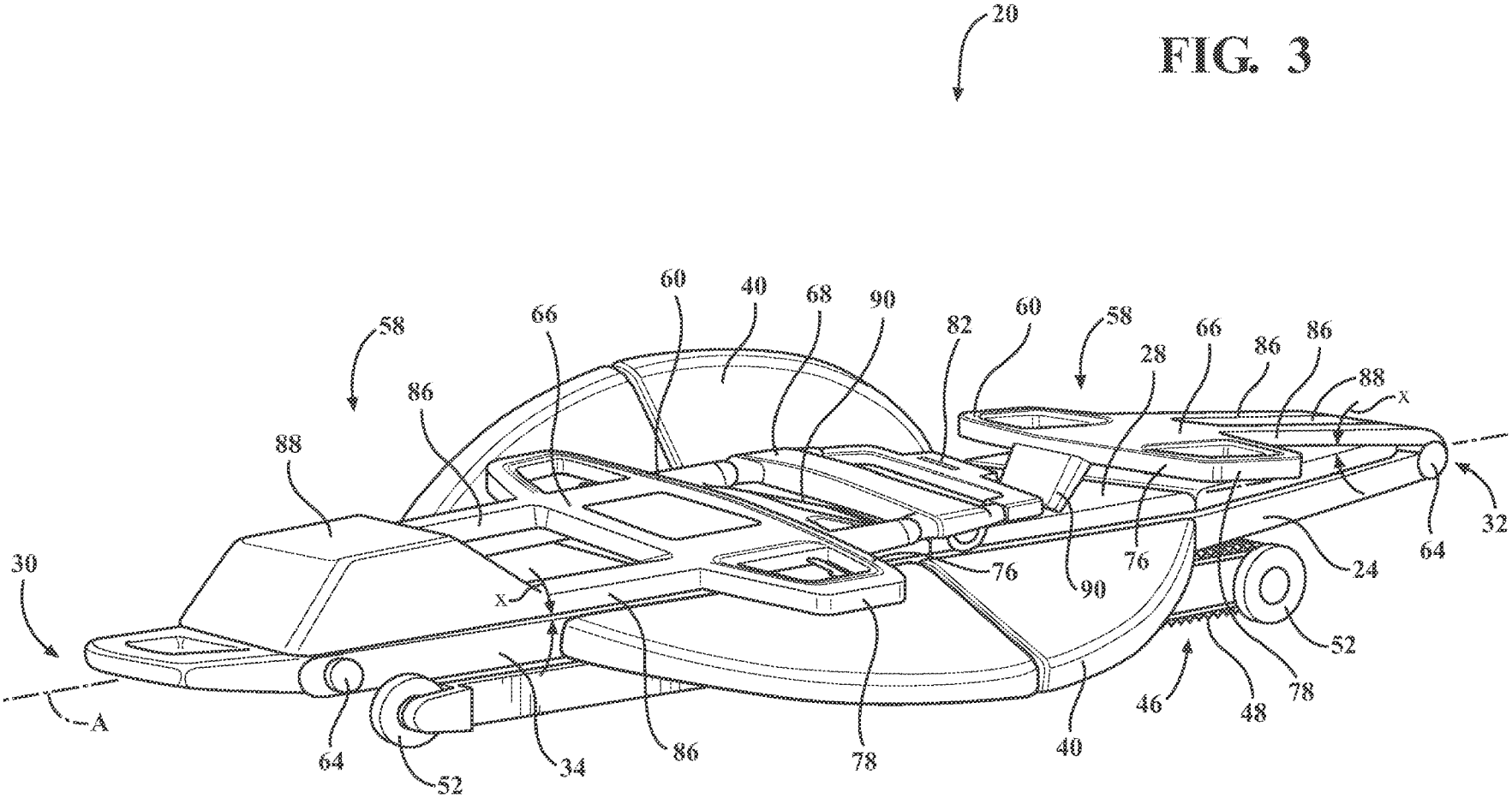
FIG. 3 is a perspective view of the patient support apparatus of FIG. 1, with both of the pair of care stations in a folded position.
Figure 4:
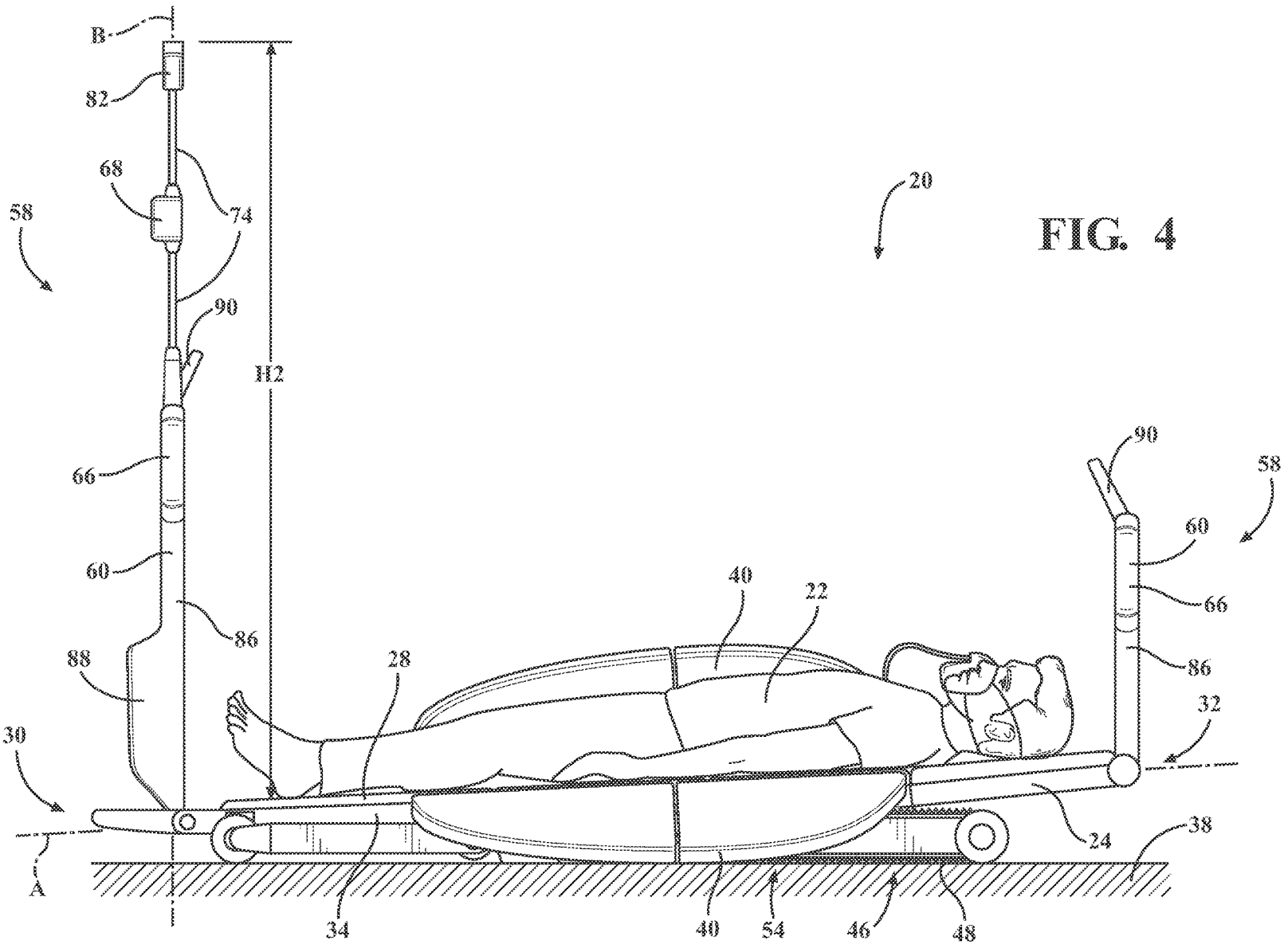
FIG. 4 is a side view of the patient support apparatus of FIG. 1, with a litter lift device supporting the litter in a lowered litter position.

As shown in FIGS. 1-3, the patient support apparatus 20 further comprises a care station 58 coupled to the litter 24 adjacent one of the first and second ends 30, 32. The care station 58 comprises a docking frame 60 coupled to the litter 24 and defining an angle X between the docking frame 60 and the axis A. The docking frame 60 is arranged to pivot relative to the litter 24 between a folded position (see FIG. 3) for stowing the care station 58 in a transport configuration and an upright position (see FIGS. 1 and 2) for accessing the care station 58 in an operable configuration. The angle X in the folded position is less than the angle X in the upright position.

As shown in FIGS. 1 and 2, the care station 58 further comprises a utility module 62 configured for use by a caregiver. The utility module 62 is arranged to selectively mount to the docking frame 60 to facilitate separation of the utility module 62 from the docking frame 60 when the care station 58 is in the operable configuration. In the exemplary embodiment shown in FIG. 1, the utility module 62 of one of the pair of care stations 58 is a box of latex/nitrile gloves while utility module 62 of the other one of the pair of care stations 58 is a power pack (i.e., a battery) to power the patient support apparatus. Other examples of utility modules 62 include, but are not limited to, surgical masks, defibrillators, ventilators, intravenous equipment and solutions, and bandaging.

The care station 58 facilitates the storage and transportation of important care items (e.g., the utility module 62) to and from the location of the patient 22 by packaging the care station 58 with the patient support apparatus 20. As such, the caregivers have only one item to take to the patient 22 rather than several individual items. Furthermore, the care station 58 is configured to adjust to support the stabilization of the patient 22 as the patient 22 is transferred to a medical care facility, as will be better understood below.

The description below further describes aspects of the litter 24 and the care station 58. These features apply both when the litter 24 is coupled to the base 26 (see FIGS. 7 and 8) and when the litter 24 is separated from the base 26 (see FIGS. 1-6). As such, discussion of the litter 24 and the care station 58 below is applicable to both configurations of the patient support apparatus 20: coupled to and separated from the base 26. Furthermore, as mentioned above, movement of the care station 58 between the folded and upright positions may be performed in either of the configurations. As such, further description below regarding the movement of the care station 58 may be applicable to either of the configurations.

As shown in FIGS. 1-3, the care station 58 may be further defined as a pair of care stations 58 with one of the care stations 58 disposed at the first end 30 of the litter 24 (e.g., a foot end) and the other one of the care stations 58 disposed at the second end 32 of the litter 24 (e.g., a head end). Each of the pair of care stations 58 may independently pivot relative to the litter 24 between the folded position and the upright position. The description below further describes aspects of the care station 58. Although only one care station 58 is explicitly described, these features apply to both of the pair of care stations 58.

As shown in FIGS. 4, 5, 7, and 8, the docking frame 60 may be substantially orthogonal to the litter 24 in the upright position. As such, the docking frame 60 extends substantially perpendicular to the patient support deck 28 in the upright position. Furthermore, the docking frame 60 may be substantially parallel to the litter 24 in the folded position, as shown in FIG. 3. As such, the docking frame 60 may lie along the patient support deck 28 in the folded position to facilitate transporting the patient support apparatus 20 to the patient 22 (i.e., the patient support apparatus 20 may be more easily carried to the patient 22 by the caregiver).

Figure 9:
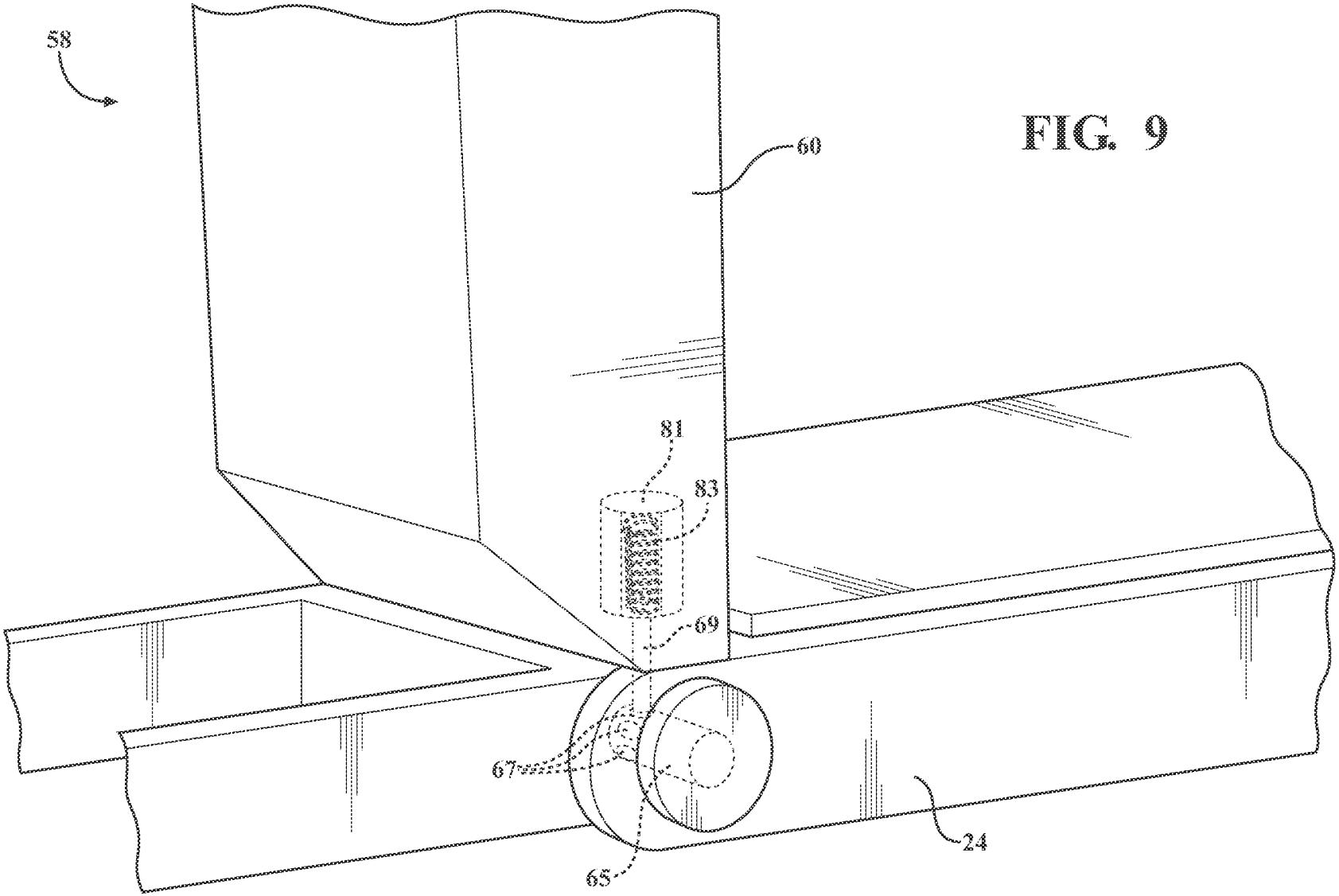
FIG. 9 is a perspective view of a portion of one of the pair of care stations and the litter, showing a lock mechanism.

As shown in FIG. 1, the patient support apparatus 20 may further comprise a lock mechanism 64 coupled to each of the docking frame 60 and the litter 24 and configured to selectively retain the docking frame 60 in the upright position. Moreover, the lock mechanism 64 may selectively retain the docking frame 60 relative to the litter 24 in the folded position or any intermediate position between the folded and upright positions. FIG. 9 shows an exemplary embodiment of the lock mechanism 64 configured to retain the docking frame 60 in the upright position, the folded position, and positions therebetween. The lock mechanism 64 comprises a shaft 65 fixed to the litter 24. The docking frame 60 pivots about the shaft 65. The shaft 65 defines a plurality of holes 67 radially spaced about the shaft 65. The lock mechanism 64 further comprises a pin 69 mounted to the docking frame 60 and movable between an engaged position in contact with the shaft 65 and a disengaged position spaced from the shaft 65. In the engaged position, the pin 69 contacts the shaft 65 within one of the holes 67 to retain the docking frame 60 relative to the litter 24. In the disengaged position, the pin 69 is spaced from the shaft 65 and the docking frame 60 is permitted to freely pivot relative to the litter 24. This configuration of the lock mechanism 64 is commonly referred to in the art as a pin and hole lock. It will be appreciated that the lock mechanism 64 may comprise any other suitable configuration for retaining the docking frame 60 relative to the litter 24, including but not limited to, a pivoting latch lock and a ball detent lock.

The docking frame 60 may include a first portion 66 pivotally coupled to the litter 24 and a second portion 68 arranged to move relative to the first portion 66 between a collapsed position having a first height H1 (see FIGS. 2, 5, 7, and 8) above the patient support deck 28 and an extended position having a second height H2 (see FIGS. 1, 4, and 6) above the patient support deck 28. The second height H2 is greater than the first height H1 for raising the docking frame 60 above the patient support deck 28 in the upright position to facilitate care to the patient 22. In one embodiment, the second portion 68 is arranged for telescoping translation along the first portion 66 between the collapsed and extended positions. Said differently, the second portion 68 may move along an axis B, along which the first and second portions 66, 68 extend. To facilitate the telescoping translation of the second portion 68, one of the first and second portions 66, 68 may define a bore 70 and the other one of the first and second portions 66, 68 may comprise elongated extensions 72, as shown in FIG. 1. The extensions 72 are disposed within and arranged to translate within the bore 70 between the collapsed and extended positions. The shape of the bore 70 laterally retains the extensions 72, which defines the movement of the extensions 72 along the axis B. It will be appreciated that the telescoping translation of the second portion 68 may be performed using any suitable mechanism. Furthermore, the second portion 68 may move relative to the first portion 66 in any suitable manner between the collapsed and extended positions, for example, by articulation.

As shown in FIG. 1, the second portion 68 of the docking frame 60 may include a plurality of subframe members 74 arranged to move relative to one another for selectively adjusting the length of the second portion 68. As such, the plurality of subframe members 74 may further facilitate adjustment of the second portion 68 between a plurality of intermediate positions between the collapsed and extended positions. The plurality of subframe members 74 are arranged for telescoping translation relative to one another. However, the plurality of subframe members 74 may move relative to one another in any suitable manner.

The care station 58 may comprise a handle 76 mounted to and extending laterally from the docking frame 60 and configured to be grasped by a caregiver to move the litter 24. The handle 76 may be spaced from the litter 24 and adjacent the second portion 68 of the docking frame 60 in order to position the handle 76 proximate the hands of the caregiver when the docking frame 60 is disposed in the upright position. Positioning the handle 76 proximate the hands of the caregiver provides improved ergonomics to the caregiver, which reduces strain on the caregiver when moving the patient support apparatus 20 and reduces the potential for injuring the caregiver. The handle 76 may further include a vertical portion 78 extending substantially parallel to the docking frame 60 to provide an engagement surface to be grasped by the caregiver that is different from the portion of the handle 76 that extends laterally from the docking frame 60. As such, the handle 76 provides multiple handle positions for the caregiver, which further improves the ergonomics of the handle 76. It will be appreciated that the handle 76 may have any suitable configuration for being grasped by the caregiver.

The handle 76 may be further defined as a pair of handles 76 disposed on opposing sides of the docking frame 60 and each configured to be individually engaged by the pair of hands of the caregiver. The pair of handles 76 may be disposed along any suitable portion of the docking frame 60 and may be positioned in any suitable configuration relative to one another. Furthermore, the handle 76 may be any suitable number of handles mounted to the docking frame 60.

Figure 6:
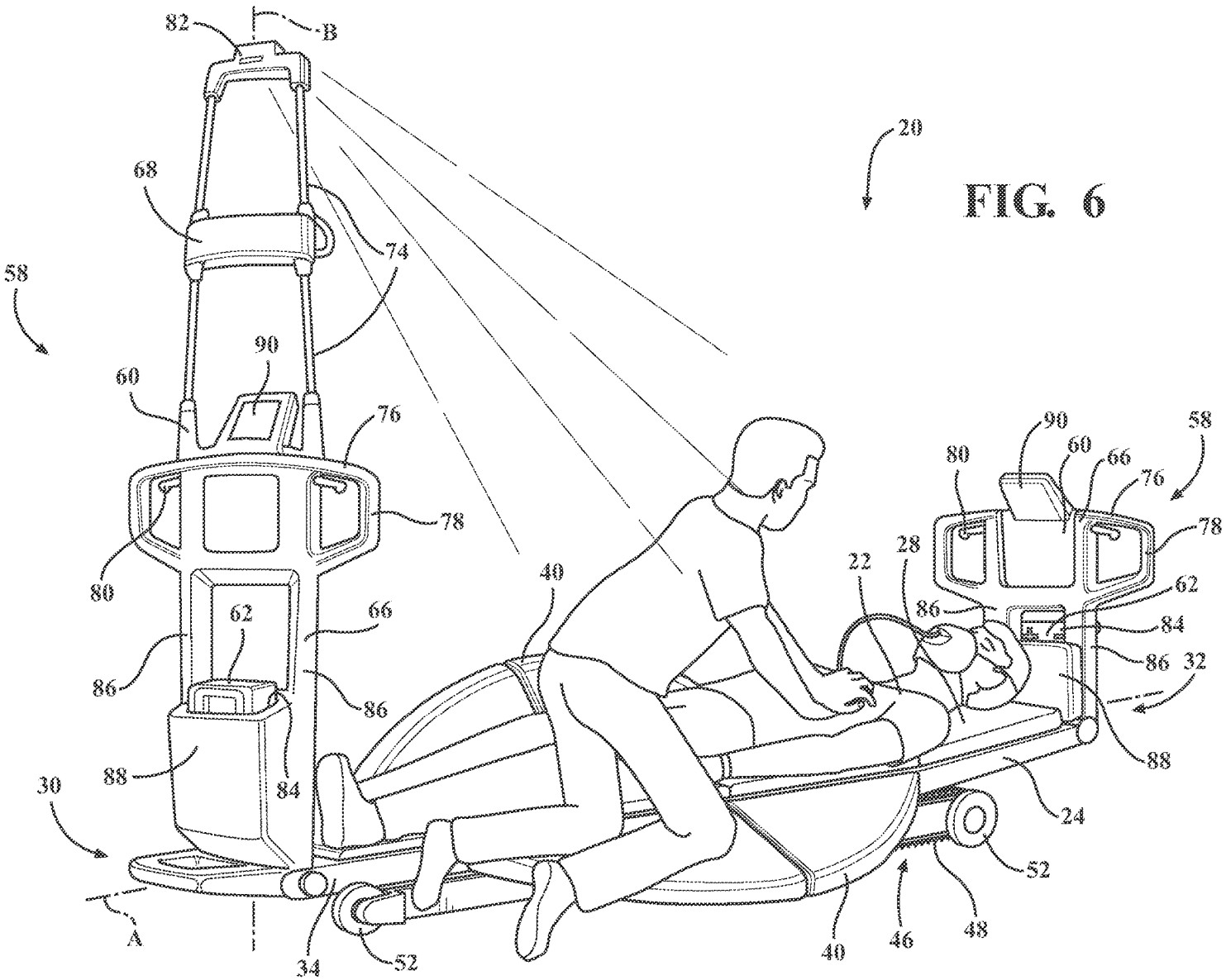
FIG. 6 is a perspective view of the patient support apparatus of FIG. 1, with a patient disposed on the litter and a caregiver providing aid to the patient.

The care station 58 may comprise at least one actuator 80. As shown in FIGS. 1, 2, and 6, the at least one actuator 80 may be pivotally coupled to the docking frame 60. The at least one actuator 80 may be coupled to the lock mechanism 64. Pivoting of the at least one actuator 80 may actuate the lock mechanism 64 to selectively retain the docking frame 60 relative to the litter 24. More specifically, pivoting of the at least one actuator 80 may disconnect the docking frame 60 from the litter 24 to allow pivoting of the docking frame 60 relative to the litter 24 (i.e., move the pin 69 shown in FIG. 9 to the disengaged position). The actuator 80 may be electronically coupled to the lock mechanism 64. In the non-limiting embodiment shown in FIG. 9, a solenoid 81 is coupled to the pin 69 of the lock mechanism 64. A bias member 83 engages and biases the pin 69 toward the engaged position. Pivoting of the actuator 80 energizes the solenoid 81, which moves the pin 69 away from the shaft 65 toward the disengaged position, against the bias of the bias member 83. When the actuator 80 is released, the solenoid 81 is de-energized and the bias of the bias member 83 moves the pin 69 to the engaged position. The actuator 80 may be electronically coupled to the lock mechanism 64 in any suitable manner. The actuator 80 may be coupled to the lock mechanism in any suitable manner, including, but not limited to, manual actuation (e.g., through actuation of a Bowden cable or linkages) and hydraulic actuation (e.g., through movement of a fluid between pistons).

As shown in the Figures, the at least one actuator 80 may be a pair of actuators 80, with one of the pair of actuators 80 coupled to the lock mechanism 64 (as described above). The other one of the pair of actuators 80 may be coupled to each of the first and second portions 66, 68 of the docking frame 60. More specifically, a second lock mechanism 85 may be coupled to each of the first and second portions 66, 68 of the docking frame (see FIG. 1), with pivoting of the actuator 80 facilitating selective retention of the second portion 68 relative to the first portion 66 through the second lock mechanism 85. More specifically, pivoting of the actuator 80 may disconnect the second portion 68 from the first portion 66 to allow movement of the second portion 68 relative to the first portion 66. The exemplary embodiments of the lock mechanism 64 described above may be applied to the second lock mechanism 85 for retaining the first portion 66 relative to the second portion 68. The at least one actuator 80 may be any number of actuators configured to be engaged by the caregiver to manipulate the patient support apparatus 20. Furthermore, although the exemplary embodiment of the at least one actuator 80 is shown in the Figures as a lever, the at least one actuator 80 may be any suitable configuration (including a button, joystick, touchscreen, etc.) to be engaged by the caregiver.

Turning to FIG. 1, the patient support apparatus 20 may further include an illumination device 82 mounted to the second portion 68 and positioned to selectively emit light toward the patient support deck 28. The illumination device 82 may be arranged to move with the second portion 68 between the collapsed and extended positions for adjusting the illumination of the patient support deck 28. More specifically, adjusting the second portion 68 between the collapsed and extended positions adjusts height of the illumination device 82 above the patient support deck 28. Raising the illumination device 82 above the patient support deck 28 widens the area of the patient support deck 28 that is illuminated by the illumination device 82. Lowering the illumination device 82 toward the patient support deck 28 narrows the area of the patient support deck 28 that is illuminated by the illumination device 82.

Figure 10:
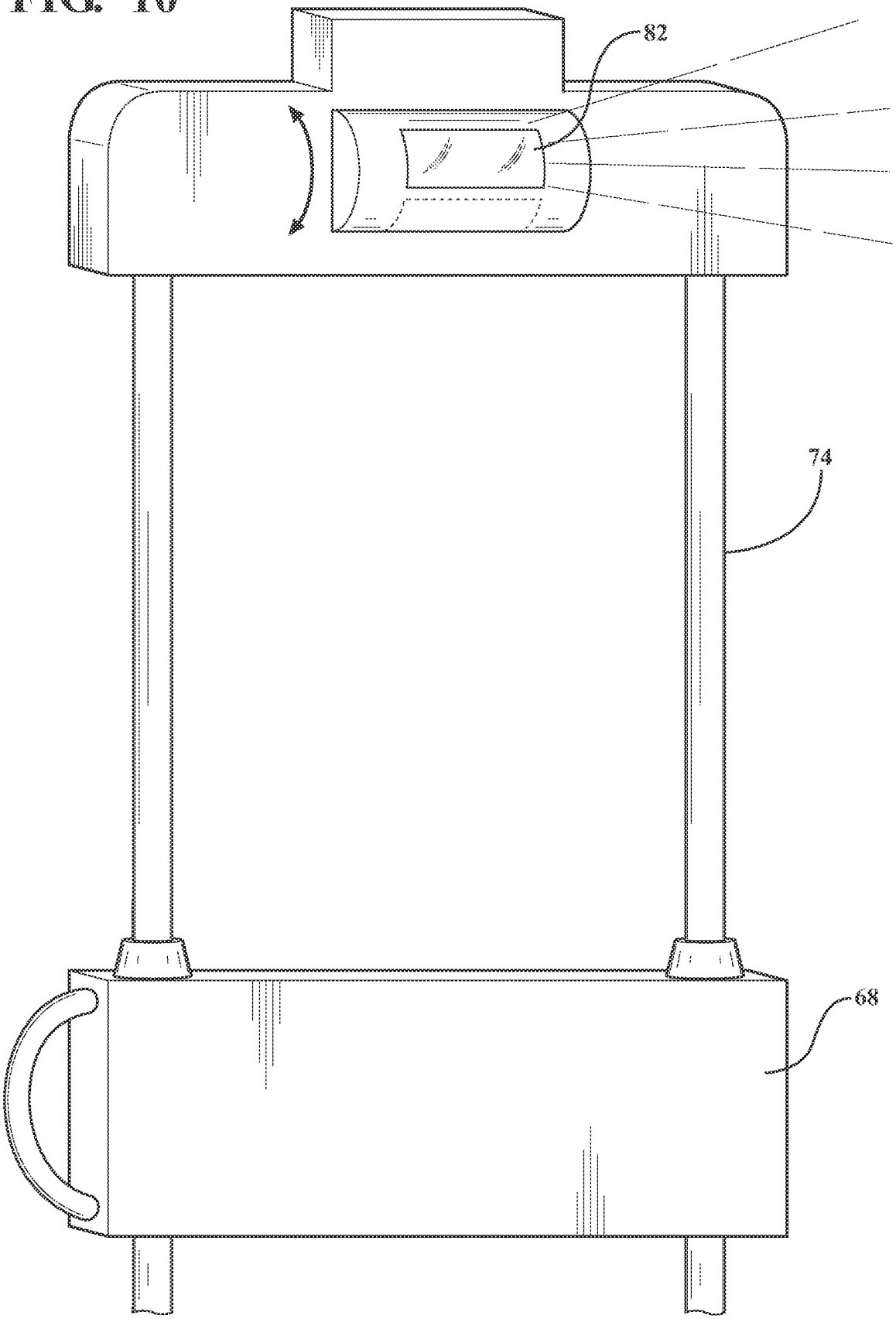
FIG. 10 is perspective view of a portion of one of the pair of care stations, showing an illumination device.

The illumination device 82 may be articulable relative to second portion 68, as shown in FIG. 10. Articulation of the illumination facilitates changing the area of the patient support deck 28 that is illuminated by the illumination device 82 without adjusting the docking frame 60. The illumination device 82 may be coupled to the second portion 68 of the docking frame 60 in any suitable manner to facilitate adjusting the illumination of the patient support deck 28.

The illumination device 82 may include a light source. The light source may be further defined as a light emitting diode. Alternatively, the light source may be further defined as a laser light source. In any embodiment, the light source is capable of emitting any type of light. For example, the light source may be capable of emitting visible light across the color spectrum. As another example, the light source may also be capable of emitting non-visible light such as ultraviolet light that may illuminate a fluorescent material on the surface. It is to be appreciated that the light source may be a single-color semi-conductor light source capable of emitting what is typically referred to as visible white light. It is also to be appreciated that the light source may be a multi-color light source with the light source capable of emitting specific colors of the visible spectrum of the light. For example, the light source may be a red-green-blue (RGB) LED capable of individually emitting visible red, green, and blue light, or in combination emitting colored light formed by the combination of at least two of the visible red, green, and blue light.

In addition, the light source may be capable of emitting the light in any direction. For example, the light source may be a 60 degree light source, with the light source emitting the light in a conical shape having an angle of 60 degrees between the outer most light as measured along a plane extending through a center of the light. It is to be appreciated that light source may be a 120 degree light source. It is also be appreciated that the light source may emit the light at any suitable angle.

In any embodiment, the light source is capable of emitting the light at any intensity. It will be appreciated that the light source could be of any suitable type or configuration and could include any suitable number of light sources.

As shown in FIGS. 1, 2, and 6, the docking frame 60 may define a storage cavity 84 configured to receive the utility module 62 therein to selectively mount the utility module 62 to the docking frame 60. The storage cavity 84 may be sized for at least partially receiving the utility module 62 therein. The storage cavity 84 may open toward the second portion 68 of the docking frame 60 to provide access to the storage cavity 84. Moreover, the storage cavity 84 opening toward the second portion 68 of the docking frame 60 prevents the utility module 62 from falling out of the storage cavity 84 as the docking frame 60 pivots between the folded and upright positions. As shown in the Figures, the first portion 66 of the docking frame 60 may comprise a pair of frame rails 86 spaced from and parallel to one another. The pair of frame rails 86 extend from the litter 24 toward the second portion 68 of the docking frame 60. The first portion 66 of the docking frame 60 may further comprise a housing 88 extending between and mounted to the pair of frame rails 86. The housing 88 may be adjacent the litter 24. The housing 88 may define the storage cavity 84.

The patient support apparatus 20 may further include a user interface 90 coupled to one of the care stations 58 for electronically controlling the litter lift device 54 to raise and lower the patient support deck 28, and/or to control any other powered device of the patient support apparatus 20. More specifically, the patient support apparatus 20 may comprise a control system. As shown in FIG. 1, the control system may comprise a controller 92 to operate and control one or more powered devices in response to actuation of input devices of the user interface 90 by the caregiver and in response to state signals that the controller receives from a sensing system.

The controller 92 also determines current states and desired states of the litter 24 and/or the base 26, based on input signals that the controller 92 receives from the user interface 90 and state signals that the controller 92 receives from the sensing system. The state of the litter 24 and/or the base 26 may be a position, a relative position to another object, an orientation, a configuration, an angle, a speed, a load condition, and an energization status, or any other state of the litter 24 and/or the base 26.

The user interface 90 is coupled to the controller 92 and comprises input devices that may be actuated by the caregiver, which transmits the corresponding input signals to the controller 92, and the controller 92 controls operation of the one or more powered devices based on the input signals and the state signals.

The user interface 90 comprises input devices capable of being actuated by the user. The user interface 90 may be configured to be actuated in a variety of different ways, including but not limited to, mechanical actuation (hand, foot, finger, etc.), hands-free actuation (voice, foot, etc.), and the like. The user interface 90 may comprise one or more of a load cell, a push button, a touch screen, a joystick, a twistable control handle, a dial, a knob, a gesture sensing device for monitoring motion of hands, feet, or other body parts of the user (such as through a camera), a microphone for receiving voice activation commands, a foot pedal, and a sensor (e.g., infrared sensor such as a light bar or light beam to sense a user's body part, ultrasonic sensor, etc.). Additionally, the buttons/pedals can be physical buttons/pedals or virtually implemented buttons/pedals such as through optical projection or on a touchscreen. The buttons/pedals may also be mechanically connected or drive-by-wire type buttons/pedals where a user-applied force actuates a sensor, such as a switch or potentiometer.

As shown in FIGS. 1, 2, and 6, the user interface 90 may be coupled to the docking frame 60. More specifically, the user interface 90 may be coupled to the docking frame 60 adjacent the handle 76 to facilitate ease of using the user interface 90 by the caregiver. In alternative embodiments, the user interface 90 is located on the handle 76 or any other suitable location. In other embodiments, more than one user interface 90 may be provided.

In some embodiments, the patient support apparatus 20 may comprise an adaptive user interface as described in U.S. Patent Application Publication No. 2018/0369036, which is hereby incorporated by reference in its entirety.

The at least one actuator 80 may be coupled to the controller 92 as shown in FIG. 1. The at least one actuator 80 transmits input signals to the controller 92, and the controller 92 controls operation of the lock mechanism 64 and the second lock mechanism 64 (as shown in FIG. 1) or any powered devices based on the input signals from the at least one actuator 80.

The patient support apparatus 20 may further comprise a side board 40 coupled to the patient support deck 28 along the litter 24 between the first and second ends 30, 32. The side board 40 may extend laterally away from the patient support deck 28. The side board 40 may be arranged to pivot relative to the litter 24 between a first position (see FIG. 5) and a second position (see FIG. 4). In some embodiments, the side board 40 may be pivoted to additional positions between the first and second positions. In the first position, the side board 40 is planar with or angled upwardly to extend above the patient support deck 28 for inhibiting patient 22 egress. In the second position, the side board 40 is angled downwardly to extend below the patient support deck 28 to facilitate loading of the patient from the floor surface 38 to the patient support deck 28.

The patient support deck 28 may comprise a pair of opposing lateral sides 34 between the first and second ends 30, 32. The side board 40 may be further defined as a pair of side boards 40. One of the side boards 40 may be disposed along one of the lateral sides 34 and the other one of the side boards 40 may be disposed along the other one of the lateral sides 34. The pair of side boards 40 may be configured to retain the patient between the side boards 40 on the patient support deck 28 when both of the pair of side boards 40 are in the first position. More specifically, the patient 22 may be positioned between the pair of side boards 40 in the first position, with pair of side boards 40 engaging the patient 22 to prevent inadvertent movement of the patient 22 laterally off of the patient support deck 28 (e.g., during transport).

The pair of side boards 40 may be configured to facilitate movement of the patient 22 along either of the side boards 40 during loading of the patient 22 from the floor surface 38 to the patient support deck 28. Said differently, the litter 24 may be configured to accommodate movement of the patient 22 up to the patient support deck 28 when the patient 22 is located on either of the pair of opposing lateral sides 34, increasing versatility of the patient support apparatus 20.

The pair of side boards 40 may be pivotable independently of one another between respective first and second positions. As such, one of the pair of side boards 40 may be in the second position to permit movement of the patient 22 from the floor surface 38 to the patient support deck 28, while the other one of the pair of side boards 40 may be in the first position (see FIGS. 1-3 and 6), which may engage the patient 22 after the patient 22 is placed on the patient support deck 28 (i.e., the other side board 40 in the first position extends above the patient support deck 28 and may present a stop to prevent accidentally pushing the patient 22 off of the patient support deck 28.) However, the pair of side boards 40 may both be simultaneously disposed in either of the first or second positions (see FIGS. 5, 7, and 8).

It will be further appreciated that the terms "include," "includes," and "including" have the same meaning as the terms "comprise," "comprises," and "comprising." Moreover, it will be appreciated that terms such as "first," "second," "third," and the like are used herein to differentiate certain structural features and components for the non-limiting, illustrative purposes of clarity and consistency.

Several configurations have been discussed in the foregoing description. However, the configurations discussed herein are not intended to be exhaustive or limit the invention to any particular form. The terminology that has been used is intended to be in the nature of words of description rather than of limitation. Many modifications and variations are possible in light of the above teachings and the invention may be practiced otherwise than as specifically described.

What is claimed is:

1. A patient support apparatus for supporting a patient, the patient support apparatus comprising:

a litter comprising a patient support deck configured to support the patient, with the litter extending longitudinally along a litter axis between a first end and a second end, with the litter configured to move along a floor surface;

a litter lift device coupled to the litter and configured to raise and lower the patient support deck relative to the floor surface; and a care station pivotably coupled to the litter adjacent one of the first and second ends, with the care station including:

a docking frame pivotably coupled to the litter and extending along a docking frame axis that defines an angle between the docking frame and the litter axis, with the docking frame arranged to pivot relative to the litter axis of the litter between a folded position for stowing the care station in a transport configuration and an upright position for accessing the care station in an operable configuration, with the angle in the folded position less than the angle in the upright position such that the docking frame is substantially parallel to the litter; and an illumination device mounted to the docking frame and positioned to selectively emit light toward the patient support deck.

2. The patient support apparatus as set forth in claim 1, wherein the docking frame is substantially orthogonal to the litter in the upright position.

3. The patient support apparatus as set forth in claim 1, wherein the docking frame includes a first portion pivotally coupled to the litter and a second portion arranged to move relative to the first portion between a collapsed position having a first height above the patient support deck and an extended position having a second height above the patient support deck, with the second height greater than the first height for raising the docking frame above the patient support deck in the upright position to facilitate care to the patient.

4. The patient support apparatus as set forth in claim 3, wherein the second portion is arranged for telescoping translation along the first portion between the collapsed and extended positions.

5. The patient support apparatus as set forth in claim 4, wherein one of the first and second portions defines a bore and the other one of the first and second portions defines an elongated extension, with the elongated extension disposed within and arranged to translate within the bore between the collapsed and extended positions.

6. The patient support apparatus as set forth in claim 3, wherein the illumination device is mounted to the second portion for concurrent movement with the second portion between the collapsed and extended positions for adjusting the illumination of the patient support deck.

7. The patient support apparatus as set forth in claim 1, wherein the care station further includes a utility module configured for use by a caregiver and arranged to selectively mount to the docking frame to facilitate separation of the utility module from the docking frame when the care station is in the operable configuration.

8. The patient support apparatus as set forth in claim 7, wherein docking frame defines a storage cavity configured to receive the utility module therein to selectively mount the utility module to the docking frame.

9. The patient support apparatus as set forth in claim 7, further including a user interface coupled to the utility module for electronically controlling the litter lift device to raise and lower the patient support deck.

10. The patient support apparatus as set forth in claim 1, wherein the care station comprises a handle mounted to and extending laterally from the docking frame and configured to be grasped by a caregiver to move the litter.

11. The patient support apparatus as set forth in claim 1, further comprising a lock mechanism coupled to each of the docking frame and the litter and configured to selectively retain the docking frame in the upright position.

12. The patient support apparatus as set forth in claim 1, further comprising a side board coupled to the patient support deck along the litter between the first and second ends and extending laterally away from the patient support deck, with the side board arranged to pivot relative to the litter between a first position planar with or angled upwardly to extend above the patient support deck for inhibiting patient egress and a second position angled downwardly to extend below the patient support deck to facilitate loading of the patient from the floor surface to the patient support deck.

13. The patient support apparatus as set forth in claim 12, wherein the patient support deck comprises a pair of opposing lateral sides between the first and second ends, with the side board further defined as a pair of side boards with one of the side boards disposed along one of the lateral sides and the other one of the side boards disposed along the other one of the lateral sides and configured to retain the patient between the side boards on the patient support deck when both of the pair of side boards are in the first position.

14. The patient support apparatus as set forth in claim 1, further comprising a transportation mechanism comprising a continuous track and a track driving device propelling the continuous track to provide mobility to the litter along the floor surface.

15. The patient support apparatus as set forth in claim 1, further comprising a base selectively coupled to and supporting the litter, the base comprising a base lift device, separate from the litter lift device, configured to raise and lower the patient support deck relative to a floor surface when the litter is coupled to the base.

16. The patient support apparatus as set forth in claim 1, wherein the care station further defined as a pair of care stations with one of the care stations disposed at the first end of the litter and the other one of the care stations disposed at the second end of the litter.

17. The patient support apparatus as set forth in claim 1, wherein the patient support deck defines a patient support surface for supporting the patient; and wherein the docking frame is disposed adjacent to the patient support surface in the folded position.

18. The patient support apparatus as set forth in claim 17, wherein the docking frame is spaced further away from the patient support surface in the upright position than in the folded position.

* * * * *